US006360555B1

(12) United States Patent
Li et al.

(10) Patent No.: US 6,360,555 B1
(45) Date of Patent: Mar. 26, 2002

(54) COMPRESSOR MOUNTING DEVICE WITH INTEGRATED MUFFLER

(75) Inventors: Wen L. Li, Fayetteville; Mark Daniels, Manlius; Rudy Chou, Fayetteville, all of NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/788,828

(22) Filed: Feb. 20, 2001

(51) Int. Cl.[7] ..... F25D 19/00
(52) U.S. Cl. ..... 62/295; 62/296; 181/403
(58) Field of Search ..... 62/295, 296; 181/403, 181/207, 208, 229

(56) References Cited

U.S. PATENT DOCUMENTS 2,247,904 A * 7/1941 Brace ..... 62/295
3,578,107 A * 5/1971 Everett et al. ..... 181/403
4,888,962 A * 12/1989 Harper et al. ..... 62/295
4,891,955 A * 1/1990 Klausing et al. ..... 62/295
5,070,708 A * 12/1991 Malosh et al. ..... 62/295
5,507,151 A * 4/1996 Ring et al. ..... 62/296
5,913,892 A * 6/1999 Kwon ..... 62/296

* cited by examiner

*Primary Examiner*—William E. Tapolcai
(74) *Attorney, Agent, or Firm*—Carlson, Gaskey & Olds, P.C.

(57) ABSTRACT

A mount both supports a compressor, and provides fluid communication, between the compressor and a heat exchanger. A first axis is defined extending through the compressor center of mass. A second axis is defined extending parallel to the first axis and positioned a distance from the first axis. A manifold is provided by the mount, and has an inlet and an outlet. The inlet is positioned along the first axis and connected to the heat exchanger and the outlet is positioned along the second axis and connected to the compressor.

18 Claims, 2 Drawing Sheets

COMPRESSOR MOUNTING DEVICE WITH INTEGRATED MUFFLER

BACKGROUND OF THE INVENTION

This invention relates to a compressor mount having an integrated muffler for supporting a compressor utilized in a chilled water air conditioning system (i.e. a chiller).

Typically a chiller is utilized in a large building where a standard single circuit system is not practical due to the long lengths of piping required and limitations on compressor capacities. The chiller includes a compressor to compress and circulate refrigerant within a heat exchanger. The refrigerant chills water contained in tubes running through the heat exchanger. Water cooled in the heat exchanger is pumped through tubing routed throughout the entire building. Air handlers disposed throughout the building are connected to the chilled water tubing to provide cool air for the building.

In chilled water systems, the connection between the compressor and the heat exchanger supports the compressor and provides a fluid path between the compressor and the refrigerant within the heat exchanger. A mount provides the connection and fluid path between the compressor and the heat exchanger. Mounting the compressor atop the cooler by way of the mount raises the compressor up off the heat exchanger, raising the compressor's center of mass. A running compressor vibrates at a particular frequency and the mount supports the compressor some distance upwardly off the heat exchanger. The combination of the distance from the heat exchanger and the vibration of the compressor creates a larger bending moment about the center of mass that exerts a high stress on the mount. In addition, fluid suction through the mount and pressure fluctuations caused by the compression of refrigerant creates undesirable noise.

For these reason it is desirable and necessary to develop a mount that can counteract forces exerted by the compressor and reduce noise emission created by the flow of fluid through the mount.

SUMMARY OF THE INVENTION

The invention provides a mount for supporting a compressor atop a heat exchanger for a chilled water air conditioning system that reduces stress exerted by the compressor onto the heat exchanger and suppresses noises caused by pressure fluctuations in the fluid passing through the mount between the compressor and heat exchanger.

The mount supports the compressor and provides fluid communication between the heat exchanger and the compressor. The compressor has a center of mass and a first axis could be defined that extends through the center of mass and perpendicular to the heat exchanger. A second axis is defined that extends substantially parallel to the first axis and is disposed a distance from the first axis and the center of mass of the compressor. The mount includes a manifold having an inlet and an outlet. The inlet is positioned along the first axis and connected to the cooler, the outlet is positioned along the second axis and connected to the compressor such that the compressor is mounted offset from the center of mass to create a moment to counteract any vibrations emanating from the compressor.

The mount includes a manifold constructed from three plates. The manifold includes first, second and third plates. Each of the plates includes an opening such that the combination of plates provides a non-linear fluid passage through the manifold. The opening in the first plate is positioned along one of the axes and the opening in the second plate is disposed along the other axis. The third plate includes an opening through which both axes extend such that the openings of the first and second plates are in fluid communication. The non-uniformity of the fluid path also constitutes a muffler that reduces the emission of noise. The third plate provides an additional muffling device positioned within the opening to reduce the emission of noise.

The subject invention overcomes the deficiencies of the prior art by providing a mount that offsets the compressor to counteract the vibration affects of the compressor and further includes an internal muffler that reduces noise emission created by pressure fluctuations in the refrigerant caused by compressor operation.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
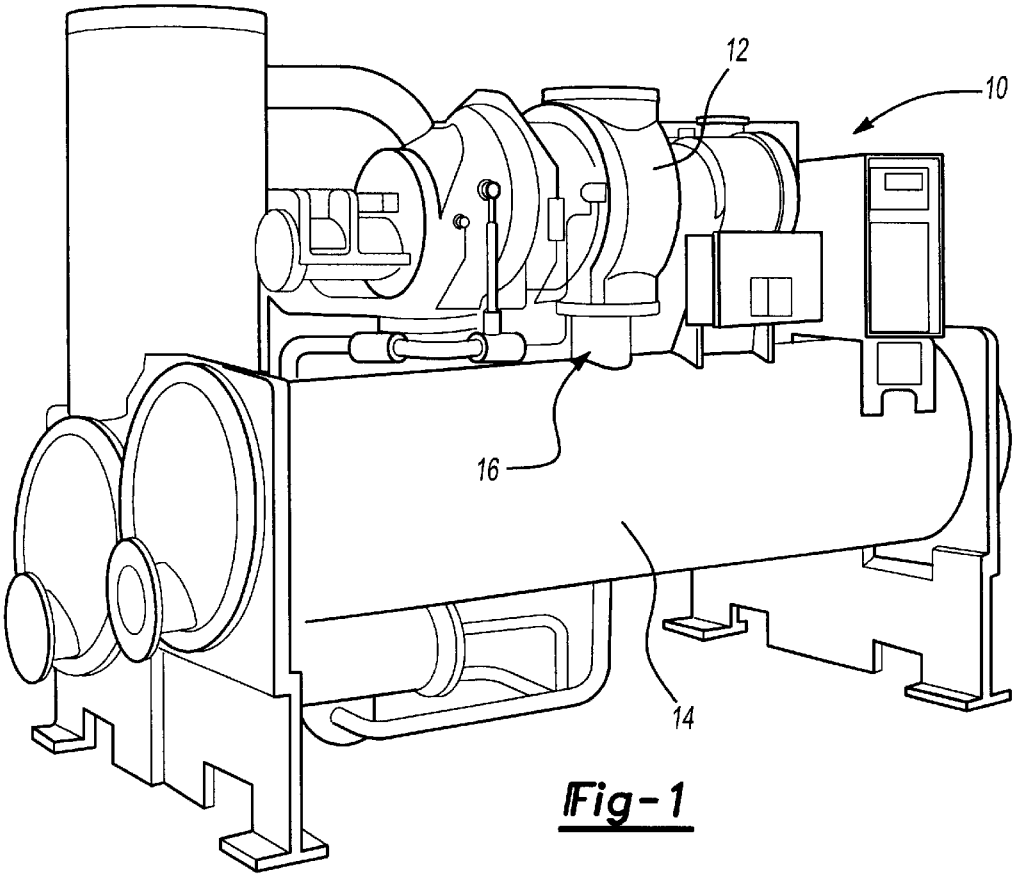
FIG. 1 is a perspective view of a chilled water air conditioning system.

Referring to the Figures, wherein like numerals indicate like or corresponding parts throughout the several views, the subject invention shown in FIG. 1 is a chilled water air conditioning system 10 including a compressor and a heat exchanger mounted together by a mount 16 to support the compressor 12 to the heat exchanger 14. In a chilled water system 10, the compressor 12 circulates refrigerant through a heat exchanger 14 in order to chill water contained in tubing running through the heat exchanger 14. The chilled water is then routed throughout the building and connected to a plurality of air handlers (not shown).

Figure 2:
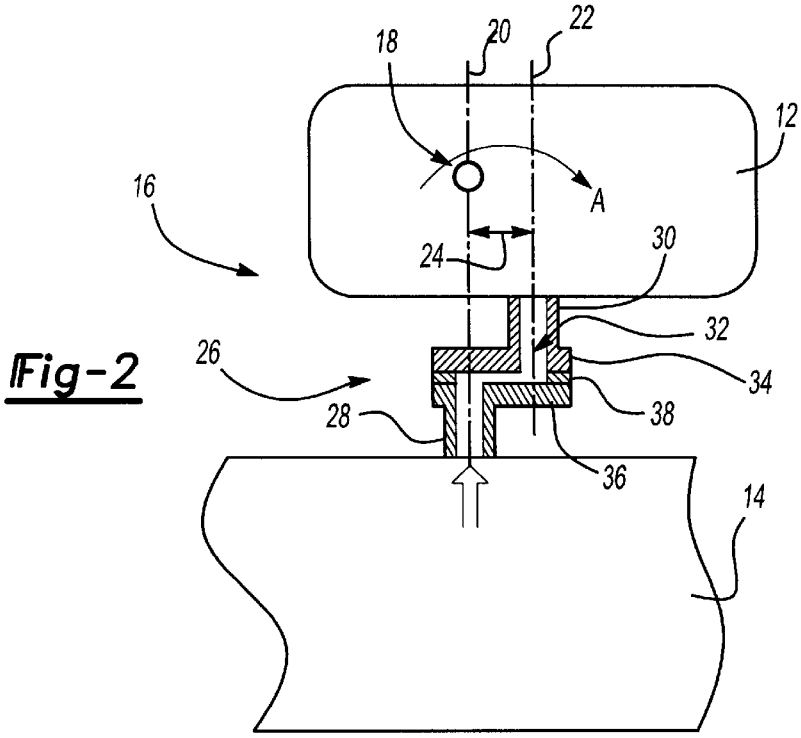
FIG. 2 is a schematic view of the mount between the compressor and the heat exchanger.

Referring to FIG. 2, the mount 16 supports the compressor 12 atop the heat exchanger 14 and provides a fluid passage through which the refrigerant is routed between the heat exchanger 14 and the compressor 12. The compressor 12 has a center of mass 18, and a first axis 20 is defined that extends through the center of mass 18 substantially perpendicular to the heat exchanger 14. A second axis 22 extends parallel to the first axis 22 and is a predetermined distance 24 from the first axis 20. The mount 16 includes a manifold 26 having an inlet 28 and an outlet 30. The inlet 28 is centered along the first axis 20 and connected to the heat exchanger 14. The outlet 30 is centered along the second axis 22 and connected to the compressor 12. Although the inlet 28 and the outlet 30 of the preferred embodiment are centered along one of the axes 20, 22, it is not necessary to the operation of the invention that the inlet and outlet be centered along one of the axes. Other configurations for the inlet and the outlet are possible and would be recognized and ascertainable to a worker knowledgeable in the art. The predetermined distance 24 between the first and second axes 20,22 is sized in such a manner to counteract vibration created by operation of the compressor 12. The mount 16 raises the compressor 12 and its center of mass 18 off the heat exchanger 14. The compressor 12 vibrates during operation and the vibration of the compressor 12 combined with the distance from the heat exchanger 14 creates a bending moment about the center of mass of the compressor indicated by arrow A, that places stress on the mount 16. The compressor 12 of the preferred embodiment is a screw compressor. Typical screw type compressors vibrate at frequencies between 300–600 hertz. To counteract this vibration the outlet 30 from the manifold 26 to the compressor 12 is offset from the center of mass 18 to counteract the vibration and the bending moment created by the vibration. The predetermined distance between the center of mass 18 of the compressor 12, or first axis 20 and the second axis 22 is determined by the specific application to create a moment opposing the bending moment shown by arrow "A" created by the vibration of the compressor 12. A worker in the art, provide with this disclosure, would be able to define the desired distance. The offset mounting of the compressor 12 may be applied to any compressor as known in the art to counteract undesirable bending moment affects on the mount 14.

The mount includes a fluid passage 32 that provides fluid communication between the compressor 12 and the heat exchanger 14. The compressor 12 draws refrigerant from the heat exchanger 14 up through the mount 16 and the offset configuration of the mount 16 breaks up the flow of refrigerant to reduce noise.

Figure 3:
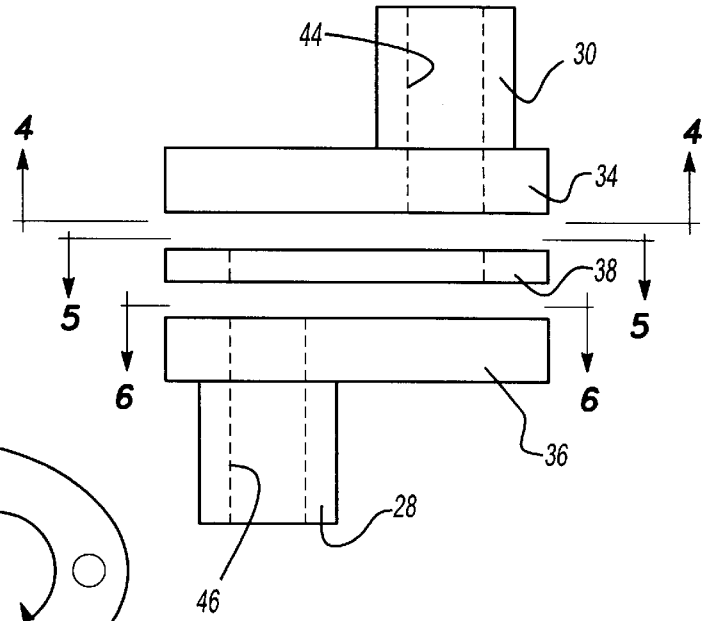
FIG. 3 is an exploded view of the manifold of the mount.
Figure 4:
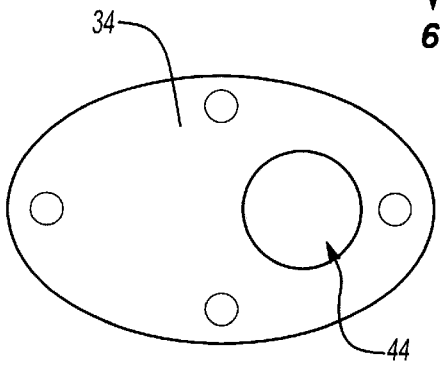
FIG. 4 is a plan view of the first plate of the manifold.
Figure 5:
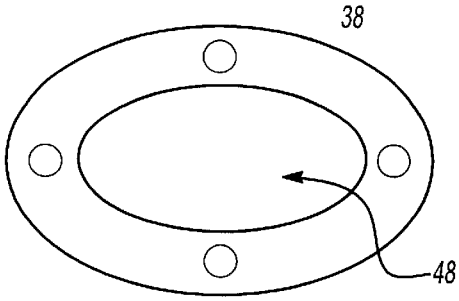
FIG. 5 is a plan view of the third plate of the manifold.
Figure 6:
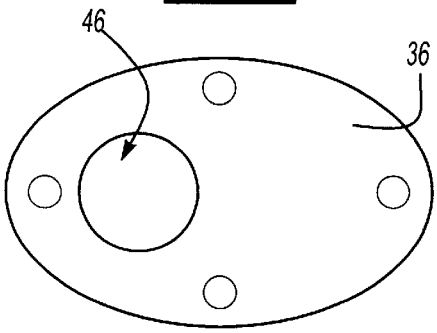
FIG. 6 is a plan view of the second plate of the manifold.

Referring to FIGS. 3 through 6, the manifold 26 is assembled from three plates 34, 36, 38 secured together by any means known in the art. In the preferred embodiment the plates 34, 36, 38 are oval shaped. The first plate 34 and the second plate 36 include first and second openings 44,46 positioned to a side of each of the first and second plates 34,36. The first and second plates 34,36 of the preferred embodiment are identical and are reversed when assembled to the third plate 38. The third plate 38 includes a larger third opening 48 that provides for fluid communication between the first and second openings 44,46 of the first and second plates 34,36. The first opening 44 is positioned about the second axis 22 a predetermined distance from the first axis 20 and the second opening 46 is positioned about the first axis 20. The third opening 48 is of such a size that both the first and second axes 20,22 pass there through, hence passages 44 and 46 communicate with opening 48. The manifold 26 is constructed by securing the three plates 34,36,38 together as shown in FIG. 3 to provide a non-linear flow path 32 through the manifold 26. The flow path 32 can also be circuitous. The resultant tortuous flow path provides sound muffling.

Although within the preferred embodiments the passages 44 and 46 extend parallel to each other, and the passage 44 extends through the center of mass of the compressor, other arrangements may provide the essential benefits of this application. As an example, it may be that the passage 46 need not be coincident with the center of mass of the compressor, and the majority of the benefits could still be provided if the two passages 44 and 46 are offset. Moreover, it is possible that the passages 44 and 46 need not be parallel, and yet the bulk of the benefits could also be provided. Thus, many arrangements are within the skill of a worker in this art.

Figure 7:
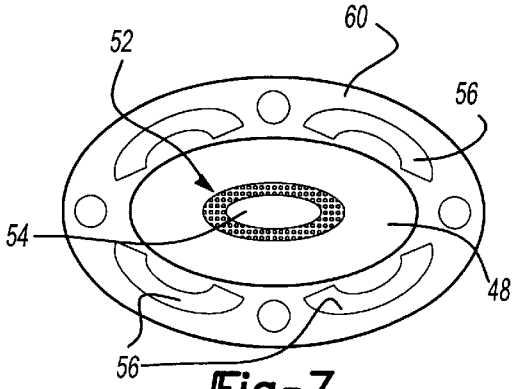
FIG. 7 is a plan view of an alternate embodiment of the third plate.
Figure 8:
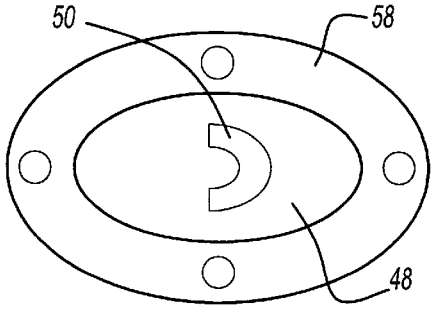
FIG. 8 is a plan view of another alternate embodiment of the third plate.

Referring to FIGS. 7 and 8, a muffler 50 may be mounted within the third opening 48 for further suppressing noise. Referring specifically to FIG. 8, a muffler 50 is disposed substantially in the center of the third opening 48. The muffler 50 is semi-circular in shape, but it should be understood that it is within the contemplation of this invention that any muffler known to a worker knowledgeable in the art may be used within the mount 16 to dampen noise emission. Referring to FIG. 7, an oval muffler 52 embodiment is shown. The oval muffler 52 includes an open center section 54 and is disposed substantially in the center of the third opening 48. Further, the embodiment shown in FIG. 7 includes a plurality of passages 56 disposed about a periphery of the third opening 48. These passages 56 are known as Helmholtz resonators and provide another means for suppressing noise. The Helmholtz resonator configuration of the alternate embodiment absorbs specific frequencies of refrigerant pressure waves passing through the third opening 48. Noise emission is reduced or eliminated by the effect of canceling out the pressure waves present in the fluid flow between the compressor and the heat exchanger.

The foregoing description is exemplary, and not a material specification. The invention has been described in an illustrative manner, and it should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. An assembly including a compressor and a heat exchanger mounted together in a chilled water air conditioning system comprising:

a compressor mounted to a heat exchanger by a mount;

said mount providing a manifold having an inlet and an outlet, said inlet disposed along a first axis and connected to the heat exchanger, said outlet disposed along a second axis and connected to said compressor, said inlet and said outlet being spaced from each other by a distance.

2. The assembly of claim 1, wherein said distance between said first and second axes is predetermined to counteract vibration created by operation of the compressor.

3. The assembly of claim 1, wherein said compressor includes a center of mass and said first axis passes through said center of mass.

4. The assembly of claim 1, wherein said first and second axes are parallel.

5. The assembly of claim 1, wherein said manifold includes first, second and third plates, and each of said plates includes an opening such that the combination of plates provides a non-linear fluid passage through said manifold.

6. The assembly of claim 5, wherein said non-linear fluid passage is circuitous.

7. The assembly of claim 5, wherein said opening in said first plate is disposed along one of said axis and said opening in said second plate is disposed along the other of said axis, and said third plate includes an opening through which both axis extend such that said openings of said first and second plates are in fluid communication.

8. The assembly of claim 4, wherein said third plate includes a muffler to suppress noise caused by flow between the heat exchanger and the compressor.

9. The assembly of claim 8, wherein said muffler is disposed within said opening and is semi-circularly shaped.

10. The assembly of claim 4, wherein said third plate provides a plurality of cavities disposed about the periphery of said opening to reduce the emission of noise caused by flow between the heat exchanger and the compressor.

11. The assembly of claim 10, wherein said plurality of cavities disposed about the periphery of said opening are Helmholtz resonators.

12. The assembly of claim 5, wherein said first plate and said second plates are identically shaped and arranged such that said openings are oppositely arranged.

13. An assembly including a compressor and a heat exchanger mounted together in a chilled water air conditioning system comprising:

a compressor mounted to a heat exchanger by a mount;

said mount providing a manifold having an inlet and an outlet, said inlet disposed along a first axis and connected to the heat exchanger, said outlet disposed along a second axis parallel to said first axis and connected to said compressor, said compressor includes a center of mass and said first axis passes through said center of mass;

said inlet and said outlet being spaced from each other by a distance and said distance between said first and second axes is predetermined to counteract vibration created by operation of the compressor.

14. The assembly of claim 13, wherein said manifold includes first, second and third plates, and each of said plates includes an opening such that the combination of plates provides a non-linear fluid passage through said manifold.

15. The assembly of claim 13 wherein said non-linear fluid passage is circuitous.

16. The assembly of claim 14, wherein said opening in said first plate is disposed along one of said axis and said opening in said second plate is disposed along the other of said axis, and said third plate is sandwiched between said first and second plates and includes an opening through which both axis extend such that said openings of said first and second plates are in fluid communication.

17. The assembly of claim 16, wherein said third plate includes a muffler to suppress noise caused by the flow of fluid between the heat exchanger and the compressor.

18. The assembly of claim 16, wherein said third plate includes a plurality of Helmholtz resonators disposed about the periphery of said opening to reduce the emission of noise caused by the flow between the heat exchanger and the compressor.

* * * * *